United States Patent [19]

Bepoix

[11] Patent Number: 4,758,167

[45] Date of Patent: Jul. 19, 1988

[54] ELECTRICAL DISTRIBUTION AND CONNECTION SYSTEM FOR USE ON AIRCRAFT

[75] Inventor: Michel Bepoix, Saint Brice sous Foret, France

[73] Assignee: Souriau & Cie, Boulogne Billancourt, France

[21] Appl. No.: 937,841

[22] Filed: Dec. 4, 1986

[30] Foreign Application Priority Data

Jun. 3, 1985 [FR] France ..... 85 08340

[51] Int. Cl.[4] ..... H01R 25/00

[52] U.S. Cl. ..... 439/49; 439/76

[58] Field of Search ..... 339/17 R, 17 C, 17 L, 339/217 S; 439/43, 49, 76, 78, 81–84

[56] References Cited

U.S. PATENT DOCUMENTS 3,766,513 10/1973 Carre ..... 339/217 S
3,771,101 11/1973 Elkins ..... 339/17 C
4,056,299 11/1977 Paige ..... 339/113 R
4,068,915 1/1978 Evans ..... 339/259 R
4,655,537 4/1987 Andrews, Jr. ..... 339/221 R

*Primary Examiner*—Neil Abrams
*Attorney, Agent, or Firm*—Larson & Taylor

[57] ABSTRACT

A system for an aircraft electrical distribution and interconnection system includes a plurality of apparatuses located side-by-side in a cabinet which receives black boxes. Each apparatus has a rack connector having connection pins distributed in a regular pattern with a first mutual spacing and each removably retained in a passage of the rack connector. The rack connector receives a mating line receptical unit having female contact elements connecting with the front ends of the pins. A printed circuit board receives the rear ends of the pins and connects them to second contacts, having a second mutual spacing greater than the first. The second contacts are secured to parallel wrapping stems which are used for interconnection by wrapping and receive routing connectors.

6 Claims, 2 Drawing Sheets

FIG.3.
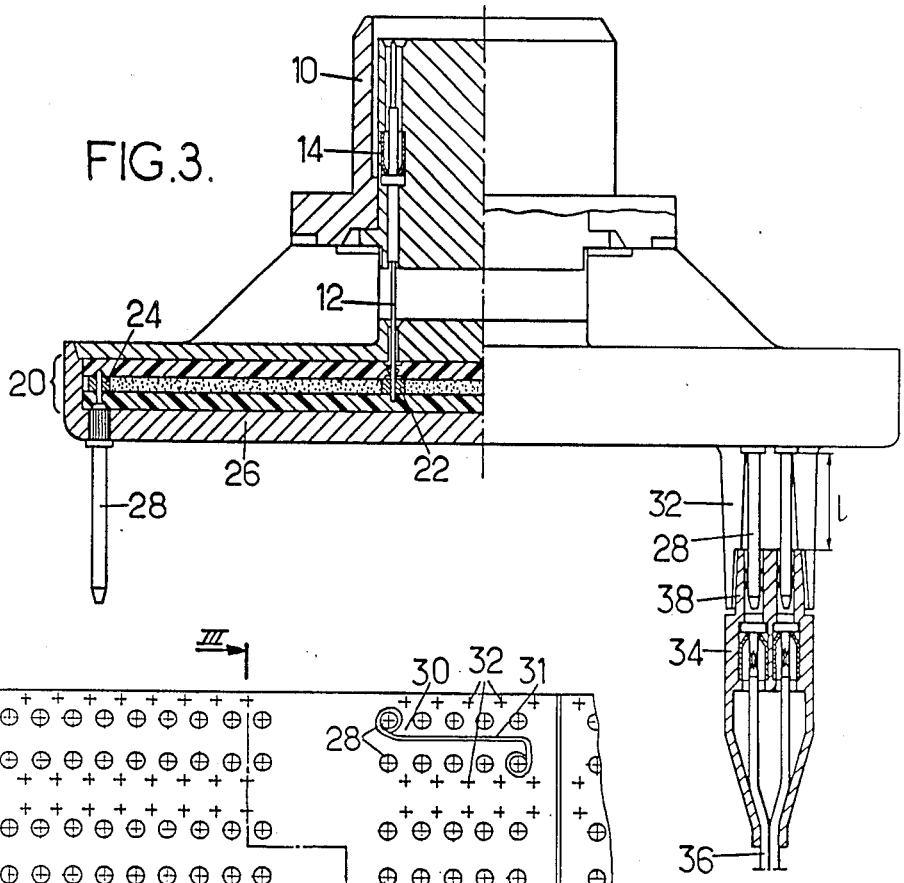
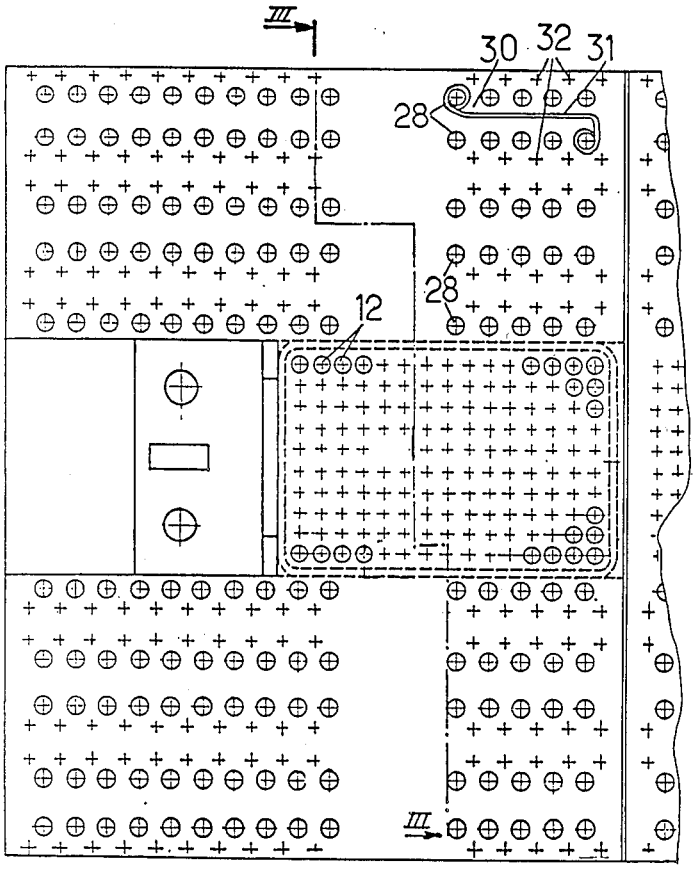
FIG.2.

ELECTRICAL DISTRIBUTION AND CONNECTION SYSTEM FOR USE ON AIRCRAFT

BACKGROUND OF THE INVENTION

1. Technical Field

The invention relates to distribution and connection systems involving a large number of electrical wires and it is particularly suitable for use on airplanes. In commercial airplanes, a large number of control or monitoring connections are made in a central bin.

2. Prior Art

A conventional construction of the bin consists in providing an enclosure having a wall and containing individual black boxes. The bottom wall carries one of the halves of connectors arranged to receive mating collector halves for electrical connection to a plate which carries interconnection or shunt bars. The bars are in turn connected, via additional connectors carried by a base, to cables for transporting measurement or control signals to different locations in the airplane.

Such an approach is complex and errors are prone to occur since the different connections are carried out manually.

SUMMARY OF THE INVENTION

It is an object of the invention to provide an improved system. It is a more specific object to decrease the time necessary for wiring and the number, weight and volume of the system.

With that purpose in mind, there is provided, in an apparatus which has an enclosure containing black boxes and having a bottom wall carrying rack connectors whose contact elements project rearwardly of the bottom wall, an interconnection assembly. The contact elements are insertable in at least one plate formed with conductive paths for connection of each of the contact elements to a respective wire-wrapping stem, each of said stem projecting out of the plate and being long enough for receiving both a coiled portion of an interconnection wire and, on its end portion, female connector contacts for connection with routing cables.

That arrangement makes it possible to distribute the wire wrapping stems according to a regular polygonal pattern with a spacing between the stems greater than the spacing between the contact elements of the connector. The interconnection conductors are substituted for the prior art shunt bars. Due to the greater spacing, the wire wrapping connections are easily made and the conductors may be located between the stems.

All components which are used in such a system are conventional in nature and have been proven in service. Most of them have been currently used in the aeronautical field for years and often for scores of years. However, up to now, the conventional approach has been retained.

It may be that the failure of those skilled in the art to conceive the system as defined above is due to the fact that wrapping connections are possible only if single-wire conductors are used while the connections for transmitting control and measurement signals from and to the different parts of the plane should use multi-wire conductors which are connected by crimping terminals thereon. That difficulty is overcome by the invention since the same stems are used both for wire wrapping connection and for receiving connector contacts which may be quite conventional, except that they will possibly have female contact elements of square or rectangular cross-section. If the latter solution is selected, some misalignment may be accepted. The wire-wrapping stems will be typically distributed in rows defining elongated channels for the interconnection wires.

The routing connectors terminating the wiring toward different parts of the aircraft may be modular: each routing connector then will correspond to a bank of stems distributed in a rectangular pattern, having two or more columns.

For permitting a very tight distribution pattern of the contact elements in the rack connectors, the plate providing electrical connections between the contact elements and the wire wrapping stems will consist of a printed circuit board, which may have one or more layers depending upon the number of the required interconnections. That board may be relatively conventional in construction except that it has means for receiving the contact elements and stems, directly embedded in the board or consisting of slidable contacts.

The invention will be better understood from the following description of a preferred embodiment, given by way of example only. The description refers to the accompanying drawings.

BRIEF DESCRIPTION OF THE DRAWINGS

FIG. 2 is a partial view from the bottom of FIG. 1, illustrating a possible distribution of the connector pins and of the stems for wire wrapping connection;

FIG. 3 is a cross-section along line III—III of FIG. 2, one only of the routing connectors being shown.

DETAILED DESCRIPTION OF THE INVENTION

Figure 1:
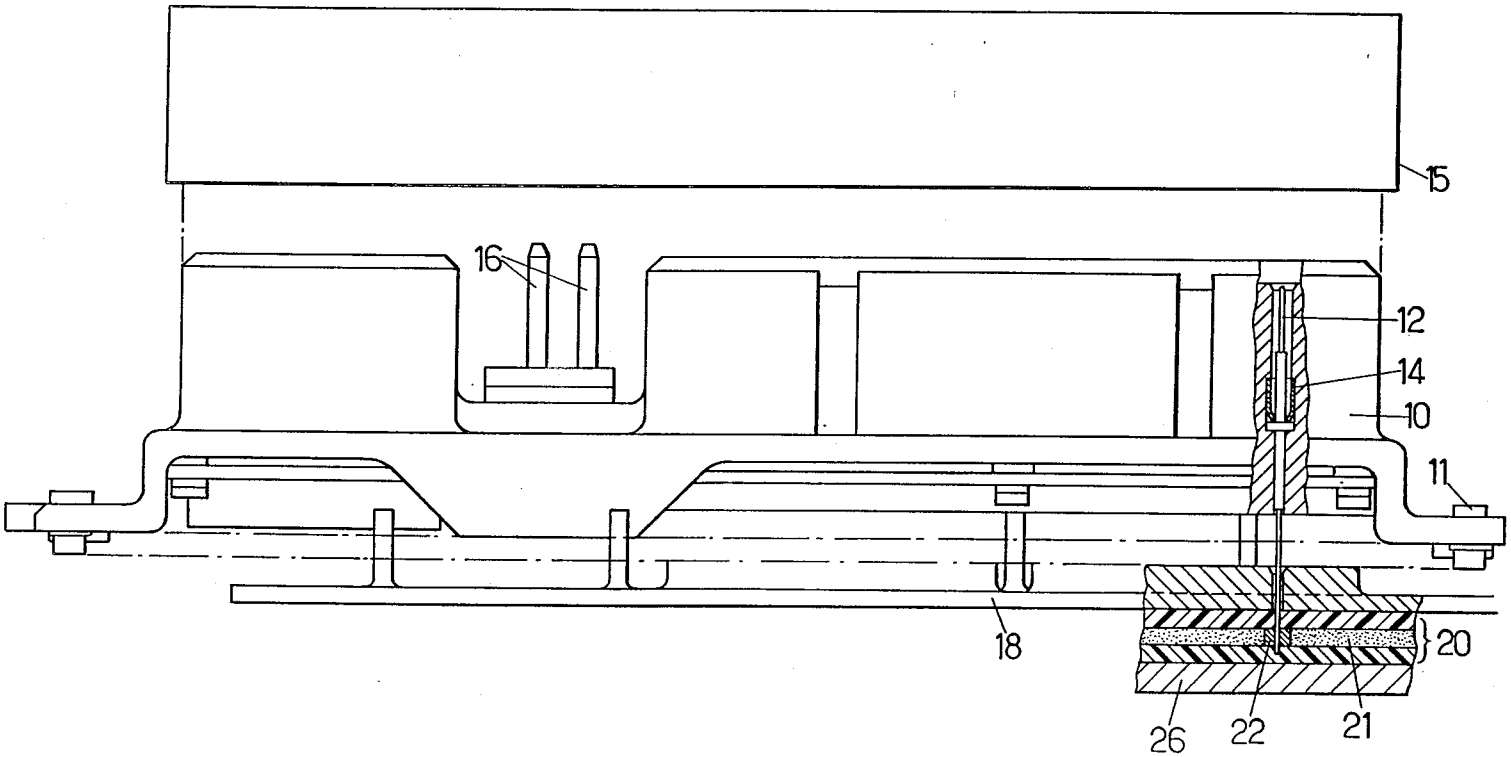
FIG. 1 is an elevational view in partial cross-section, illustrating a rack connector and part of the interconnection printed circuit board associated therewith.

Refering to FIG. 1, the shell 10 of a rack connector is removably fixed by appropriate means 11, such as screws 11, to the back wall of a cabinet (indicated in dash-dot lines). The connector shell contains an insulating body formed with passages each receiving a connecting pin 12. As illustrated in FIG. 1, each pin is removable from the connector body by drawing it forwardly (upwardly on FIG. 1) after a tool has been introduced into the passage for bending back the locking fingers of a contact retainer 14. That retainer may be of conventional nature and consists of an expandable sleeve formed with a pair of inwardly bent fingers.

Shell 10 is arranged to receive a mating connector or line receptable unit (LRU) 15 having female contact elements and associated with a black box (not shown). As shown, the rack connector may be in compliance with the ARINC 600 standard and include power transmission pins 16. For avoiding errors when inserting a LRU, each rack connector shell 10 may be provided with angularly settable abutments specific to that shell and which prevent insertion of any LRU other than the one which it should receive.

The rear parts of connection pins 12 project out of the connector shell 10 over a sufficient length for their end portions to traverse the cabinet back wall and a back plate 18. The rear part of each connection pin should have an insulating layer where it projects through back plate 18 or that back plate should be insulating.

The end portions of the connection pins 12 are electrically connected to a conductive path on or in a connection board 20. As illustrated, that board consists of a printed circuit board having two insulating lateral layers and one or more intermediate layers 21 carrying conductive paths each between a conductive insert 22 for slidably receiving a pin and a respective conductive ring or metal-plated hole 24. The rings 24 are distributed on board 20 in a regular polygonal pattern having a larger spacing than that of the inserts 22. As illustrated, inserts 22 are located in the central portion of board 20 and rings 24 are located around the central portion. Due to that arrangement the pins 12 and wire wrapping stems 28 each connected to one of the rings 24 may project throughout the intermediate layers. On the other hand, it would also be possible to locate rings 24 and stems 28 in the mid-portion as well, possibly by using an insulating relay plate.

The printed circuit board 20 is clamped between the back plate 18 and a cover plate 26 which may be of electrically conducting material, as long as the pins 12 are short enough for not contacting the covering plate.

Some stems 28 only have been illustrated in FIG. 3. In fact, a large number of such stems are provided and may be distributed as indicated by circles on FIG. 2.

As illustrated in FIG. 3, each stem 28 has a main portion of rectangular or square cross-section projecting out of the covering plate 26 (downwardly in FIG. 3) and a small diameter extension for permanent electrically conductive connection with a respective ring 24. An electrically insulating sleeve including a radial flange is located between each stem 28 and the cover plate 26.

The unit consisting of stems 28, cover plate 26, and board 20 may be assembled before it is definitely secured onto back plate 18.

It will be appreciated that the stems 28 are distributed with a mutual spacing substantially greater than that between pins 12, as seen in FIG. 2, and constitute rows. Sufficient gaps exist between the rows for constituting channels 30 receiving insulated single wire conductors providing the necessary interconnections between the stems. On FIG. 2 (where the stems have been illustrated as circles rather than squares) one single wire conductor has been illustrated. Due to the spacing between mutually adjacent stems, semi-automatic wrapping may be used and the length of conductor between mutually connected stems may be arranged in the channels with a few crossings.

Projections 32 from covering plate 26 may be arranged between the rows, for instance where illustrated by crosses on FIG. 2. Such projections may help in defining the channels. As illustrated in FIG. 3, they further constitute a receiving frame for female routing connectors 34 which constitute routing connectors. One of such routing connectors 34 is schematically illustrated in simplified form on FIG. 3. It comprises an insulating body formed with passages each receiving a female contact element having a front end portion shaped for mating with the end portion of stems 28 and a cylindrical rear portion for crimping on the multiwire insulated conductors of a routing cable 36. The respective size of projections 32 and of the body of routing connector 34 are such that the latter is engageable on part only of the length of stems 28 and a length l remains available for mini-wrapping connection. A number of identical routing connectors 34 will be located in adjcent position in a well-known manner. The connectors 34 retain the wrapping connectons in place and increase reliability.

In a modified embodiment, each stem 28 has a square cross-section in that portion which receives a mini-wrapping connection and a cylindrical end portion for making it possible to use conventional contacts.

A number of modifications are possible. For instance, an array cover (not shown) may be located over the cover plate 26, in addition to or in place of projections 32 for receiving the routing connectors 34.

Among other advantages the invention increases the reliability due to the use of automatic mini-wrapping and increased spacing between the contacts and possible replacement of a defective connection by extraction and replacement of the failed pin 12 or female contact element 38.

What is claimed is:

1. In an electrical distribution and connection system for an aircraft and the like, having a cabinet provided with a bottom wall and arranged to receive line receptable units, a plurality of apparatuses each comprising:

(a) a rack connector carried by said bottom wall, having a shell, electrically insulating means received in said shell and formed with a plurality of passages parallel to an axial direction and a plurality of connection pins each removably retained in one of said passages and each having a forward portion for receiving a mating contact of a line receptable unit and a rear portion which projects out of said electrically insulating means, said connection pins distributed with a predetermined mutual spacing;

(b) a printed circuit board securely connected to said shell, having electrically conducting paths each connecting a first contact arranged for electrical connection with the rear portion of a respective one of said pins and a respective one of a plurality of second contacts, such second contacts being distributed in a regular pattern at a mutual distance greater than said mutual spacing.

(c) a plurality of stems each connected to one of said second contacts and projecting from said printed circuit board through a covering plate in a direction opposite to said rack connector, said stems being distributed in parallel rows and having a rectangular cross-section at least in a portion thereof close to said printed circuit board and said covering plate being in contact with and secured to said printed circuit board;

(d) a plurality of connections between pairs of said stems consisting of lengths of single wire insulated conductors having end portions wrapped on said portions of rectangular cross-section of the stems of said pairs; and (e) a plurality of routing connectors each having a plurality of removable contacts for mating engagement on terminal portions of a sub-group of said plurality of stems;

(f) said covering plate having a plurality of projections arranged between the parallel rows of said stems, constituting a receiving frame for the routing connectors and defining channels receiving said single wire insulated conductors.

2. Apparatus according to claim 1, wherein said connection pins are individually retained in the body of said rack connector by releasable retaining means, whereby each of said pins may be removed axially forwardly.

3. Apparatus according to claim 1, wherein said printed circuit board is a multilayer circuit board.

4. Apparatus according to claim 1, wherein each of said pins is removably engaged into said circuit board and each of said stems is permanently secured to said board.

5. Apparatus according to claim 1, having a plurality of said rack connectors fixed in adjacent positions on a back plate of a cabinet for receiving black boxes.

6. Apparatus according to claim 1, wherein each of said stems has an end portion of cylindrical cross-section for receiving a respective one of the contacts of the routing connectors.

* * * * *